US006497437B1

(12) United States Patent
Münch et al.

(10) Patent No.: US 6,497,437 B1
(45) Date of Patent: Dec. 24, 2002

(54) SLIDE ROD LOCKING DEVICE

(75) Inventors: Udo Münch, Sinn (DE); Wolfgang Reuter, Burbach (DE)

(73) Assignee: Rittal-Werk Rudolf Loh GmbH & Co. KG, Herborn (DE)

( * ) Notice: Subject to any disclaimer, the term of this patent is extended or adjusted under 35 U.S.C. 154(b) by 0 days.

(21) Appl. No.: 09/600,615

(22) PCT Filed: Dec. 10, 1998

(86) PCT No.: PCT/EP98/08033

§ 371 (c)(1),
(2), (4) Date: Sep. 1, 2000

(87) PCT Pub. No.: WO99/36654

PCT Pub. Date: Jul. 22, 1999

(30) Foreign Application Priority Data

Jan. 19, 1998 (DE) ..... 198 01 721

(51) Int. Cl.[7] ..... E05C 9/02; E05B 3/00

(52) U.S. Cl. ..... 292/336.3; 292/41; 292/139; 292/DIG. 53

(58) Field of Search ..... 292/36, 41, 33, 292/336.3, DIG. 31, 167, 166, 168, 158, 139, DIG. 53

(56) References Cited

U.S. PATENT DOCUMENTS 2,461,393 A * 2/1949 Paxton
2,721,750 A * 10/1955 Rudis
4,025,096 A * 5/1977 Geer
4,493,499 A * 1/1985 Stenglein
5,375,894 A * 12/1994 Schlack
5,685,181 A * 11/1997 Ramsauer
5,722,269 A * 3/1998 Simon

FOREIGN PATENT DOCUMENTS

DE 77 23 134 12/1977

* cited by examiner

*Primary Examiner*—Flemming Saether
(74) *Attorney, Agent, or Firm*—Pauley Petersen Kinne & Erickson

(57) ABSTRACT

A slide rod locking system, especially for locking the door of a switchgear cabinet, having a handle which is coupled to a control element by a control mechanism. The handle can move around a pivotal axis running perpendicular to the plane of the cabinet door. The control element can move in a parallel position relative to the plane of the cabinet door as a result of the movement of the handle. The slide rod locking system transmits powerful locking forces and at the same time can have a low-height design structure by arranging a lever on an articulated joint of the handle at a distance from the pivotal axis. The lever enables the force introduced into the handle to be transmitted to the control element and can modify its angle position with respect to the handle when moved.

13 Claims, 2 Drawing Sheets

SLIDE ROD LOCKING DEVICE

BACKGROUND OF THE INVENTION

1. Field of the Invention

This invention relates to a sliding rod locking device for locking a cabinet door of a switchgear cabinet, having a handle, to which an actuating mechanism is connected via an actuating mechanism, wherein the handle can be adjusted in a pivot plane extending vertically with respect to the plane of the cabinet door, and by displacement of the handle, the actuating member can be displaced parallel with respect to the plane of the cabinet door.

2. Description of Related Art

A sliding rod lock used for locking emergency exit doors is known from German Patent Reference DE 77 23 134. A handle is seated, pivotal around a horizontal axis, in a housing. The handle has a manipulating device facing the user on the front of the housing. A lever is formed on the handle remote from the manipulating device. An actuating member is connected to the lever and is linearly displaceable in the housing. The actuating member has teeth, which mesh with a gear wheel. A second actuating member also has teeth, which also engage with the gear wheel.

The lever is deflected by an actuation of the manipulating device, and with it the first actuating member is displaced. During this the gear wheel is also turned, and the second actuating member is displaced in the opposite direction with respect to the first direction. In order to achieve the required closing forces with such a sliding rod locking device, the lever must be of an appropriate size. But this causes the sliding rod locking device to have a structural size which is interfering when used with a switchgear cabinet.

SUMMARY OF THE INVENTION

It is one object of the invention to provide a sliding rod locking device of the type mentioned above but with a small structural size and by which it is possible to simultaneously generate large locking forces.

Such object of this invention is attained with a lever hinged on a hinge of the handle at a distance away from the pivot shaft, by which the force introduced into the handle can be transferred to the actuating member and which changes its angular position when the handle is displaced.

An effective force transfer can occur at the lever mechanism in accordance with this invention, so that large locking forces can be generated. The lever can be designed as a toggle lever, which creates a force amplification with increasing pivoting. This makes it possible to overcome the oppositely acting sealing pressure when the cabinet door is closed. In the pivoted-in condition of the handle, the position of the movable lever can be adjusted so that it has only a slight effect on the structural size of the sliding-rod locking device.

In accordance with a preferred embodiment of this invention, the handle is connected with its pivot shaft on the actuating member, and the lever is pivotally fastened by an area remote from the hinge on a housing, which can be fixed in place on the cabinet door.

Alternatively, the handle can be connected with its pivot shaft on the housing, and the lever is pivotally fastened on the actuating member at its area remote from the hinge. In one embodiment of this invention, a first sliding unit can be displaced in a first direction via the lever. A further lever is connected to the handle, which displaces a second sliding unit in a direction opposite the first sliding unit. In this case the levers are preferably hinged to the handle so that sliding forces of equal size can be generated via the two sliding units.

For easier manipulation, the handle can be maintained on the housing prestressed in a direction counter to the pivoting direction by a restoring spring. Thus the handle always is urged in the pivoted-out position.

In the pivoted-in condition the handle is preferably fixed in place in a handle recess of the housing, so that it is received in a space-saving manner. The handle can have a snap-in shoulder for locking, which is maintained in a snap-in receiver of a bolt, wherein the bolt is displaceably maintained in the housing. The bolt itself is connected via a transfer element to a lock, wherein it can be displaced via the transfer element by the lock, so that the snap-in receiver disengages with the snap-in shoulder and releases the handle. Actuation of the handle is only possible if the bolt is released via the lock. Thus the switchgear cabinet is dependably secured against unauthorized access.

In accordance with this invention, the housing can be fastened to the front of the cabinet door and receive the linearly displaceable actuating member. The actuating member is connected by one or several retainers through one or several openings of the cabinet door to a sliding rod arranged on the back of the cabinet door. Since only the sliding rod is arranged on the back of the door, the sliding rod locking device can also be used, if restricted space conditions prevail in the locking area.

In this case the sliding rod can be designed as a profiled angle section, which is guided by one profiled leg on the back of the cabinet door and which extends with its second profiled leg that runs at a right angle with respect to the first profiled leg, along a vertically extending, bent-off edge of the cabinet door. A sliding rod designed in this way requires only little space and thus takes restricted spatial conditions into consideration.

BRIEF DESCRIPTION OF THE DRAWINGS

This invention will be explained in greater detail in what follows by means of exemplary embodiments shown in the drawings wherein.

Figure 1:
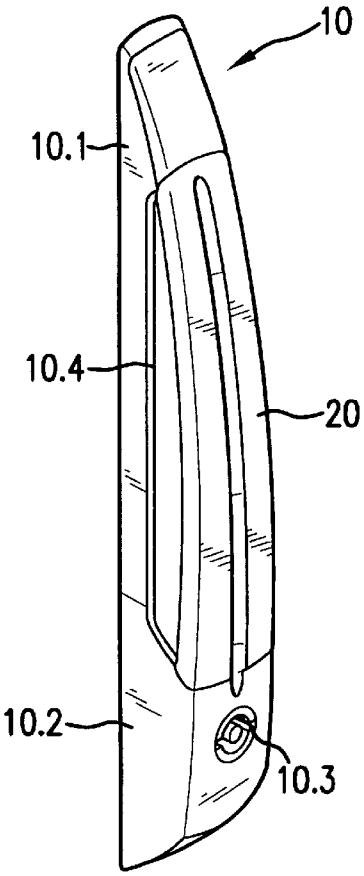
FIG. 1 is a perspective side view of a sliding rod locking device with the handle in a pivoted in condition.

DESCRIPTION OF PREFERRED EMBODIMENTS,

A sliding rod locking device, which has a housing 10 with a handle recess 10.4 is shown in FIG. 1. The housing 10 is made of two parts comprising a base housing 10.1 and an attachment housing 10.2. With the attachment housing 10.2 installed, the base housing 10.1 and the attachment housing 10.2 together form the handle recess 10.4. A handle 20 is housed in the handle recess 10.4. FIG. 1 shows that in a pivoted-in condition the handle 20 is received within the handle recess 10.4 and with its surface flush with the housing 10. The attachment housing 10.2 receives a lock 10.3.

Figure 2:
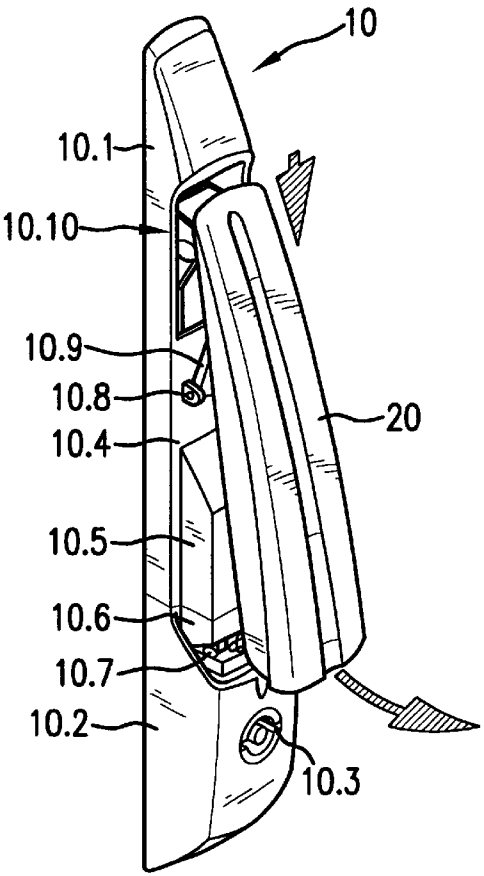
FIG. 2 is a perspective side view of the sliding rod locking device in accordance with FIG. 1 but with the handle in a partially pivoted out condition.

A sliding rod locking device in accordance with FIG. 1 is shown in FIG. 2 wherein, however, the handle 20 is partially pivoted out of the handle recess 10.4. As shown, the handle 20 is connected with the housing 10 via an actuating mechanism 10.10. The functioning of the actuating mechanism 10.10 will be explained later, making reference to FIG. 4.

A bolt 10.7, which is housed in a bolt receptacle 10.6, is used for fixing the handle 20 in place in the pivoted-in condition. On its outer contour, the bolt receptacle 10.6 has centering devices 10.5 on which the handle 20 is laterally stabilized in the pivoted-in condition.

It is thus assured that the handle 20 cannot be laterally bent off by force.

Figure 3:
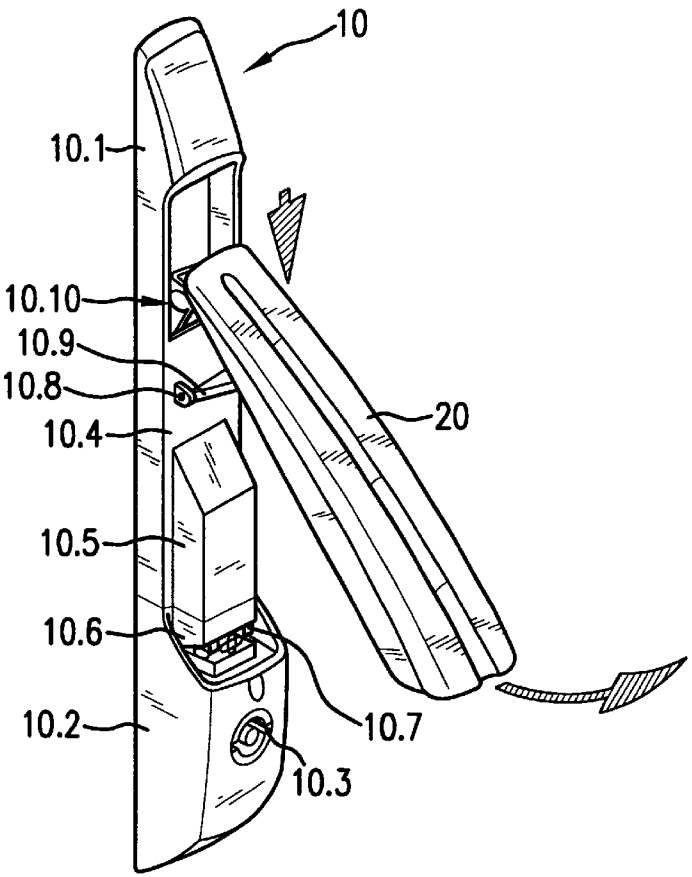
FIG. 3 is a perspective side view of the sliding rod locking device in accordance with FIGS. 1 and 2 but with the handle in a completely pivoted out condition.

The sliding rod locking device is shown in a completely pivoted-out condition in FIG. 3.

Figure 4:
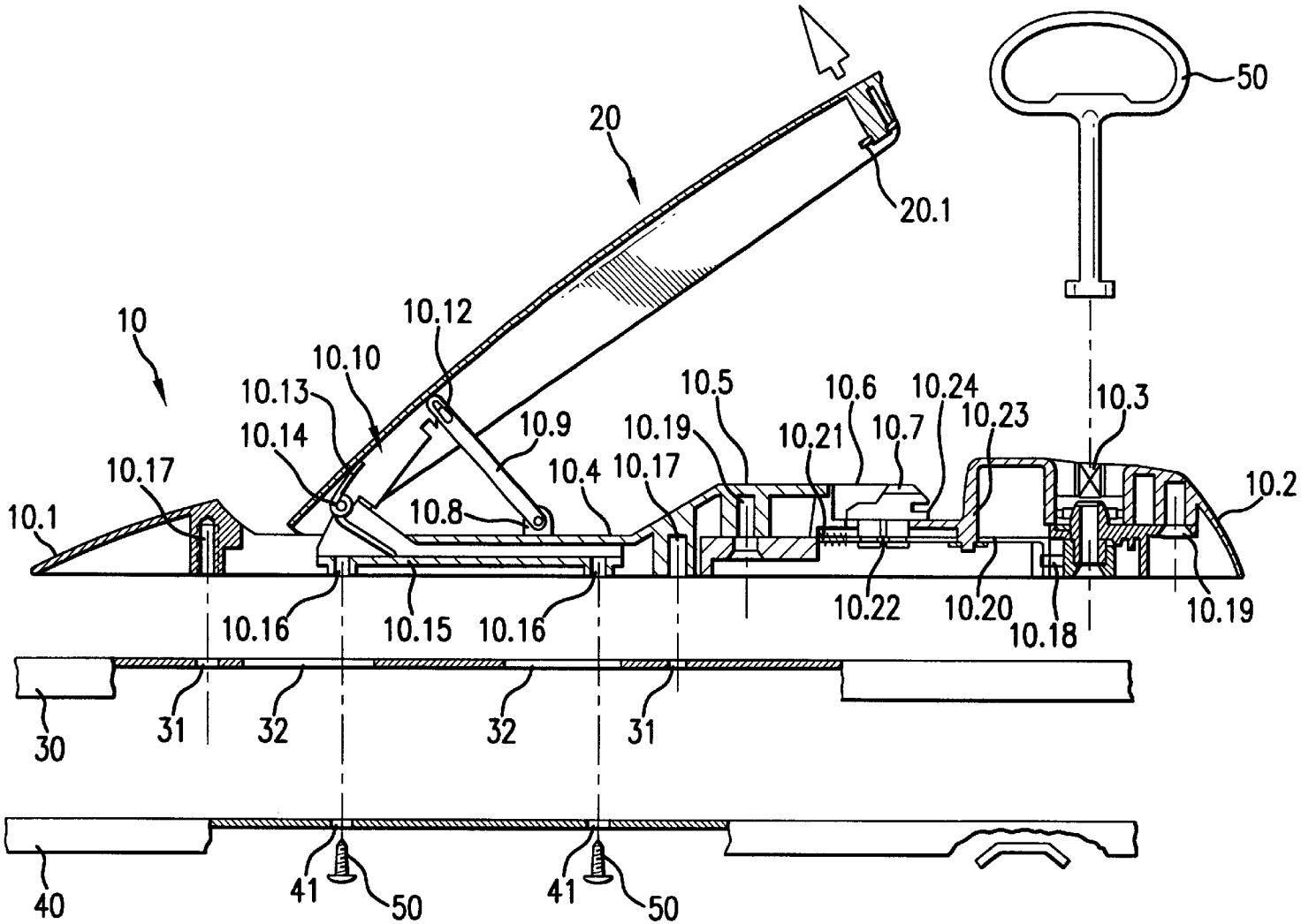
FIG. 4 is a side sectional view of the sliding rod locking device in accordance with FIGS. 1 to 3, with the handle in the pivoted out condition.

To explain the functioning of the sliding rod locking device, particular reference is made to FIG. 4. FIG. 4 shows the sliding rod locking device in a side view and in section. On one end, the handle 20 is connected to an actuating member 10.15 by a hinge 10.14. The hinge 10.14 forms a horizontal pivot axis, around which the handle 20 can be pivoted. A restoring spring 10.13 is also arranged in the area of the hinge 10.14. The restoring spring 10.13 maintains the handle 20 under spring-loaded tension, so that it is maintained in the pivoted-out position. Thus, the restoring spring 10.13 acts opposite the inward pivoting direction of the handle 20. A lever 10.9 is provided as a further component of the actuating mechanism 10.10. The lever 10.9 is fastened on a pivot bearing 10.8, which projects out of the handle recess 10.4. The lever 20 is connected with the handle 20 on its end remote from the pivot bearing 10.8. The lever 20 has an elongated hole 10.12 for this purpose, in which a bolt of the handle 20 is received.

To move the handle 20 into the pivoted-in position, it is necessary to exert a force on the handle 20. While pivoting the handle 20, the applied force is transferred via the actuating mechanism 10.10 to the actuating member 10.15, so that the actuating member 10.15 can be linearly displaced in the base housing 10.1. In this case the lever 10.9 transfers the applied force, so that large locking forces can be transferred via the actuating member 10.15. The actuating member 10.15 has two retainers 10.16. In the present case, the retainers 10.16 are designed as threaded receivers. By the retainers 10.16, the actuating member 10.15 can be connected to a sliding rod 40 through openings 32 in a cabinet door 30. The sliding rod 40 has two screw receivers 41, into which fastening screws 50 can be inserted and screwed into the retainers 10.16 through openings 30. It is also possible for the threaded bolts to be attached to the retainer 10.16. The threaded bolts are passed through the openings 32 and the screw receivers 41 and are secured by a nut. The openings 32 are designed as elongated holes. Because of a linear displacement of the actuating member 10.15, the sliding rod 40 is also linearly displaced on the back of the cabinet door 30. The sliding rod 40 is designed as a profiled angle section with two profiled legs arranged at right angles with respect to each other. Here, the one profiled leg rests on the back of the cabinet door 30. The second profiled leg rests against an edge of the cabinet door 30. For locking the cabinet door 30 on a switchgear cabinet, the sliding rod 40 has locking elements which cooperate with corresponding counter elements of the switchgear cabinet.

The bolt 10.7 is used for fixing the handle 20 in the pivoted-in position. The bolt 10.7 is held, linearly displaceable, in the bolt receiver 10.6 and has a snap-in receiver 10.24, into which a correspondingly designed snap-in shoulder 20.1 of the handle 20 can snap. The bolt 10.7 is connected to a transfer element 10.20, which is received, linearly displaceable, in the attachment housing 10.2. The transfer element 10.20 is maintained, pre-stressed against a spring 10.21. The spring 10.21 urges the bolt 10.7 in a snapped-in position as shown in FIG. 4. While pivoting the handle 20 in, the snap-in shoulder 20.1 acts on an inclined deflection face of the bolt 10.7 and thus is displaced opposite the action of the spring. After passing the inclined deflection face, the snap-in shoulder 10.7 snaps into the snap-in receiver 10.24 of the bolt 10.7 and the bolt 10.7 snaps back into its initial position. To release this locking, the transfer element 10.20 is connected to a lock 10.3. The lock 10.3 is received in the attachment housing 10.2. The lock can be operated by a locking element 50, so that the transfer element 10.20 and the bolt 10.7 are displaced. During this the bolt 10.7 releases the handle 20, so that it can be moved into its pivoted-out position.

Here, the elongated hole 10.12 takes on an essential function because the handle 20 is seated by a pin. Play is thus purposely generated. As soon as the bolt 10.7 releases the handle 20, the pin is displaced in the in the elongated hole 10.12 because of the spring prestress exerted by the restoring spring 10.13. This makes it possible for the handle 20 to pivot out of the handle recess 10.4 for a distance. It can then be comfortably grasped and can be completely pivoted out.

Screw connections 10.19 are used to fix the attachment housing 10.2 on the base housing 10.1.

What is claimed is:

1. In a sliding rod locking device in combination with a cabinet door (30) of a switchgear cabinet, having a handle (20) to which an actuating mechanism (10.10) is connected, wherein the handle (20) can be adjusted in a pivot plane extending perpendicularly with respect to a plane of the cabinet door (30), and by displacement of the handle (20) an actuating member (10.15) can be displaced parallel with respect to the plane of the cabinet door (30), wherein a lever (10.9) is hinged on a hinge (10.12) of the handle (20) at a distance away from a pivot shaft (10.14) by which a force introduced into the handle (20) can be transferred to the actuating member (10.15) and which changes an angular position of the actuating member (10.15) with respect to the handle (20) when the handle (20) is displaced, the improvement comprising:

a housing (10) fastened to a front of the cabinet door (30) and receiving the actuating member (10.15) in a linearly displaceable manner; and the actuating member (10.15) having at least one threaded receiver (10.16), and the actuating member (10.15) connected to a sliding rod (40) arranged on a back of the cabinet door (30) by one of a bolt and a screw extending through an opening of the cabinet door (30) and having a first end connected to the at least one threaded receiver (10.16) and a second end connected to the sliding rod (40).

2. In the sliding rod locking device in accordance with claim 1, wherein the handle (20) is connected with the pivot shaft (10.14) on the actuating member (10.15), and the lever (10.9) is pivotally fastened at an area remote from the hinge (10.12) on a housing (10), which is fixable in place on the cabinet door (30).

3. In the sliding rod locking device in accordance with claim 1, wherein handle (20) is connected with the pivot shaft (10.14) on the housing (10), and the lever (10.9) is pivotally fastened on the actuating member (10.15).

4. In the sliding rod locking device in accordance with claim 3, wherein a first sliding unit (40) is displaced in a first direction via the lever (10.9), and a further lever is connected to the handle (20) which displaces a second sliding unit in a direction opposite the first direction.

5. In the sliding rod locking device in accordance with claim 4, wherein the handle (20) is maintained on the housing (10) prestressed in a direction counter to a pivoting direction by a restoring spring (10.13).

6. In the sliding rod locking device in accordance with claim 5, wherein in a pivoted-in condition the handle (20) is fixed in place in a handle recess (10.4) of the housing (10).

7. In the sliding rod locking device in accordance with claim 6, wherein the handle (20) has a snap-in shoulder (20.1) maintained in a snap-in receiver (10.24) of a bolt (10.7) in the pivoted-in condition of the handle (20), the bolt (10.7) is maintained displaceably in the housing (10) and is connected via a transfer element (10.20) to a lock (10.3), and the bolt (10.7) is displaceable via the transfer element (10.20) by the lock (10.3) so that the snap-in receiver (10.24) disengages with the snap-in shoulder (20.1) and releases the hand (20).

8. In the sliding rod locking device in accordance with claim 7, wherein the sliding rod (40) is designed as a profiled angle section which is guided by one profiled leg on the back of the cabinet door and which extends with a second profiled leg which extends at a right angle with respect to the first profiled leg along a vertically extending bent edge of the cabinet door (30).

9. In the sliding rod locking device in accordance with claim 1, wherein a first sliding unit (40) is displaced in a first direction via the lever (10.9), and a further lever is connected to the handle (20) which displaces a second sliding unit in a direction opposite the first direction.

10. In the sliding rod locking device in accordance with claim 1, wherein the handle (20) is maintained on the housing (10) prestressed in a direction counter to a pivoting direction by a restoring spring (10.13).

11. In the sliding rod locking device in accordance with claim 1, wherein in a pivoted-in condition the handle (20) is fixed in place in a handle recess (10.4) of the housing (10).

12. In the sliding rod locking device in accordance with claim 1, wherein the handle (20) has a snap-in shoulder (20.1) maintained in a snap-in receiver (10.24) of a bolt (10.7) in the pivoted-in condition of the handle (20), the bolt (10.7) is maintained displaceably in the housing (10) and is connected via a transfer element (10.20) to a lock (10.3), and the bolt (10.7) is displaceable via the transfer element (10.20) by the lock (10.3) so that the snap-in receiver (10.24) disengages with the snap-in shoulder (20.1) and releases the handle (20).

13. In the sliding rod locking device in accordance with claim 1, wherein the sliding rod (40) is designed as a profiled angle section which is guided by one profiled leg on the back of the cabinet door and which extends with a second profiled leg which extends at a right angle with respect to the first profiled leg along a vertically extending bent edge of the cabinet door (30).

* * * * *